US005283952A

United States Patent [19]

Mock et al.

[11] Patent Number: 5,283,952

[45] Date of Patent: Feb. 8, 1994

[54] REPLACEMENT CARTRIDGE FOR A SHAVER WITH AN APPLICATOR

[75] Inventors: Elmar Mock, Biel; Philipp Gaechter, Itingen, both of Switzerland

[73] Assignee: Kai Industries Co. Ltd., Seki, Japan

[21] Appl. No.: 820,927

[22] Filed: Jan. 15, 1992

[30] Foreign Application Priority Data

Jan. 17, 1991 [CH] Switzerland ..... 00125/91

[51] Int. Cl.[5] ..... B26B 19/40

[52] U.S. Cl. ..... 30/41; 30/90

[58] Field of Search ..... 30/41, 41.5, 90, 124, 30/125

[56] References Cited

U.S. PATENT DOCUMENTS

| | | | |
|---|---|---|---|
| 1,899,841 | 2/1933 | Acken . | |
| 2,866,265 | 12/1958 | Kells | 30/41 |
| 3,417,468 | 12/1968 | Miyauchi | 30/41 |
| 3,726,009 | 4/1973 | Hackmyer | 30/41 |
| 4,023,269 | 5/1977 | Lopez, Jr. | 30/41 |
| 4,653,188 | 3/1987 | Kwak | 30/41 |
| 4,753,006 | 6/1988 | Howe | 30/41 |
| 5,072,512 | 12/1991 | Noujain | 30/41 |
| 5,092,041 | 3/1992 | Podolsky | 30/41 |

FOREIGN PATENT DOCUMENTS

| | | |
|---|---|---|
| 463992 | 1/1992 | European Pat. Off. . |
| 2634154 | 1/1990 | France . |
| 279398 | 11/1951 | Switzerland . |

*Primary Examiner*—Douglas D. Watts
*Assistant Examiner*—Hwei-Siu Payer
*Attorney, Agent, or Firm*—Walter C. Farley

[57] ABSTRACT

A replacement cartridge (1) for a shaver with an application device has an application preparation reservoir (2) and means for feeding the application preparation such as a small manually operated pump (3), and a connecting piece (10). The replacement cartridge is fixed to the shaver by a coupling between the connecting piece (10) and a counterpart (4). In the new state of the replacement cartridge, the interior of the small pump (31) is filled with application preparation. The integration of the small pump into the replacement cartridge (1) and its initial filling with preparation permits a simple design of the pump. The pump has a pump chamber (31) whose walls have elastically deformable points and two one-way valves (32, 33). A preparation reservoir has a hollow body whose interior is subdivided into a preparation chamber (22) and an air chamber (23) by a movable plunger (21).

8 Claims, 3 Drawing Sheets

REPLACEMENT CARTRIDGE FOR A SHAVER WITH AN APPLICATOR

FIELD OF THE INVENTION

The invention is in the field of personal hygiene and relates to a replacement cartridge for a shaver, as well as to a corresponding shaver having an application device, the exchange cartridge having a reservoir for an application medium.

BACKGROUND OF THE INVENTION

Swiss patent application 1131/90-5 describes an application device, which can be integrated into a shaver and with which a main preparation is spread over the skin directly upstream of the razor blade in the shaving direction. The application device comprises an applicator and a feed mechanism. The applicator has an application roll and a system of supply channels and is used for spreading the preparation over the skin. The feed mechanism has a reservoir for the preparation and means with which the preparation is fed into the applicator, e.g., a small manually operable pump.

The same application and also U.S. Ser. No. 07/718,557 (Now patented, U.S. Pat. No. 5,168,628) disclose complete shavers into which corresponding application devices are integrated. The supply mechanism can form the handle of the shaver, while the applicator is installed in the shaver head or is mounted on a blade holder on the applicator. In all the embodiments shown in both applications, the individual parts of the application device are firmly interconnected, so that the shaver becomes unusable as soon as one of the parts no longer functions.

If the shaver has a fixed blade or blades, the reservoir is advantageously dimensioned in such a way that it is empty when the blade is no longer sharp. Such a shaver is a disposable unit and must be manufacturable in an extremely economical manner. Such a shaver, like all disposable articles, has the advantage of absolute maintenance freedom.

However, if the shaver has a replaceable blade or blades, it is advantageous to construct the reservoir in such a way that it can be refilled, so that the shaver life is neither dependent on the blade, nor on the size of the reservoir. The user is willing to spend more on such a shaver, so that it can be given better quality, esthetics and ergonomics. However, the shaver suffers from the disadvantage that its reservoir must be refilled. Nevertheless, this disadvantage can be eliminated by a replacement cartridge, which constitutes a replaceable reservoir with the preparation. Another disadvantage is that if the reservoir becomes empty the pump can fill with air, which means that the pump must be designed in such a way that it can not only pump but also suck the preparation and this disadvantage cannot be obviated by using a replacement cartridge with a reservoir.

It has been found that those parts of the shaver which come into contact with the preparation must be cleaned every so often. This more particularly applies in the case of a preparation which tends to solidify and undergoes chemical changes as a result of contaminants introduced. Such cleaning presupposes that the pump is relatively robust and is in particular accessible for cleaning purposes. A pump satisfying these requirements cannot simultaneously be designed in such a way that it is operable with minimum forces. It has been found that small pumps which can be operated with a slight finger pressure are very sensitive to contamination and in particular to introduced, solid contaminants, such as hair fragments. It is also not easy to clean such small pumps because they are very small and when one is mounted on the shaver it cannot be flushed with rapidly flowing liquid. However, if the pump is not cleaned or is not cleanable, it will be the pump which limits the shaver life.

SUMMARY OF THE INVENTION

An object of the invention is to provide a replacement cartridge for a shaver with an applicator, so that the shaver with the replacement cartridges has both the advantages of a disposable unit and those of a non-disposable unit. The shaver with the replacement cartridge must be easy to look after and its life must not be dependent on its being cared for by the user. The cartridge must be designed in such a way that it can be replaced with simple manipulations and that on replacement it is not possible to introduce contaminants into the contaminant-sensitive parts, such as the pump.

BRIEF DESCRIPTION OF THE DRAWINGS

This object is achieved by a replacement cartridge and shaver described in greater detail hereinafter with reference to the following drawings, wherein.

DESCRIPTION OF THE PREFERRED EMBODIMENT

Figure 1:
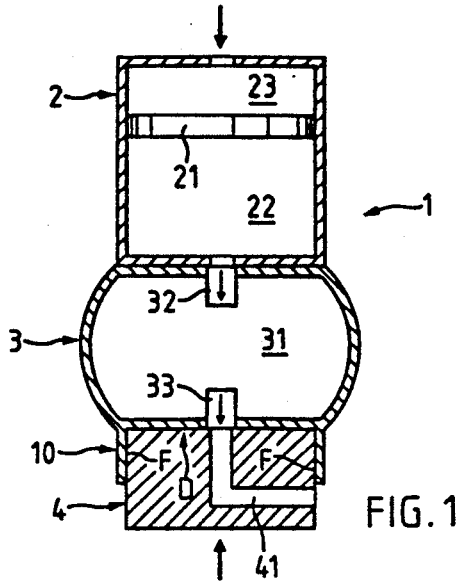
FIG. 1 is a highly simplified sectional view of a first embodiment of the inventive replacement cartridge mounted on the counterpart of the shaver for illustrating operation.

The inventive replacement cartridge not only has a reservoir with the preparation, but also incorporate means with which the application preparation can be fed into the application device of the shaver. These means can comprise a small pump. However, it can also be constituted by a deformable reservoir container, in which by compression the pressure necessary for pressing out is produced, or a reservoir container in the form of a pressure element with a propellant gas.

Due to the fact that the pump is part of the replacement cartridge and not the shaver, four different advantages are obtained. Firstly the pump does not have to be designed for a long life; secondly, it need not be accessible for cleaning purposes; thirdly, in this way contaminants cannot be introduced between the reservoir and the pump, which could then be flushed into the latter by the preparation flow; and fourthly, each new replacement cartridge can be filled with preparation so that the pump is full and it consequently need not have to be designed so as to suck the application preparation. It is therefore possible to use a sensitive, but inexpensive, pump which can be operated with minimum force.

The replacement cartridge also has a connecting piece which is so constructed that, together with a corresponding counterpart which is part of the shaver it forms a connecting device for connecting the replacement cartridge to the shaver. The connecting device is not only used for fixing the replacement cartridge to the shaver, but also, optionally together with other shaver parts, forms at least one channel which is tight with respect to the outside for the preparation between the replacement cartridge and the applicator. The connecting piece and the counterpart are so matched to one another that in the fitted state of the replacement cartridge they connect the preparation outlet of said cartridge in tight manner to the shaver channel system.

If the replacement cartridge and the shaver are constructed in such a way that the hand movement necessary for operating or activating the means for feeding the application medium into the applicator consists of pressing the replacement cartridge or part of it against the shaver or part of it, this hand movement can easily be performed with the same hand as is guiding the shaver.

A shaver with such a replacement cartridge need only be cleaned in the areas of the application device, the blade and in the sealing area of the counterpart. This is possible without difficult manipulations, because of all the surfaces to be cleaned, as well as the supply channels for the application device, are readily accessible to flowing water when the replacement cartridge is removed. In order to further facilitate shaver care for the user, it is conceivable, besides the replacement cartridge containing the preparation, to supply an identical cleaning cartridge containing a cleaning or disinfecting agent, with the aid of which the application device channels an be flushed through.

FIG. 1 shows in a highly schematic representation the principle of an embodiment of the inventive replacement cartridge 1, which is fitted to a shaver counterpart 4. It is possible to see the operation of such a replacement cartridge. The replacement cartridge 1 comprise a reservoir part 2, a pump part 3 and a connecting piece 10. The connecting piece 10 is fixed to the counterpart 4, which is in turn fixed to the shaver, by a coupling at location F. The connecting piece 10 and counterpart 4 are so matched to one another that in the fitted state they form a connection tight with respect to the outside between the preparation outlet of the replacement cartridge and the channel system for the preparation in the shaver. This can be brought about by corresponding sealing surfaces at location D.

The reservoir part 2 comprises a hollow body with two openings, in which is movably mounted a plunger 21. The plunger 21 splits the cavity of the reservoir part 2 into a preparation chamber 22 and an air chamber 23, so that each of the two chambers 22 and 23 has an opening. The pump part 3 is connected to the opening of the preparation chamber 22 and essentially comprises an elastically compressible pump chamber 31, which in diagrammatic form is represented as a bulgeable vessel, with an inlet one-way valve 32 and an outlet one-way valve 33 (shown as boxes with the travel direction). The inlet valve 32, which is positioned between the pump chamber 31 and the preparation chamber 22, is designed in such a way that it opens when there is a pressure gradient from the preparation chamber 22 to the pump chamber 31. The outlet valve 33, which is fitted to the outlet of the pump chamber 31 and in the fitted state of the replacement cartridge 1 leads the pump chamber 31 with the supply channel 41 to the razor applicator (not shown in the drawing) is designed in such a way that it opens when there is a pressure gradient from the pump chamber 31 to the feed channel 41.

The replacement cartridge 1, which the user buys either with the shaver or separately, is filled with preparation. If the pump is designed in such a way that it can suck the preparation, it is sufficient if the preparation chamber 22 is filled to its maximum volume. The preparation chamber 22 can either be filled through an outlet opening prior to the fitting of the pump part 3, or when the replacement cartridge is fitted by means of a filling opening in the wall of the preparation chamber or in the plunger 21 which is to be closed after filling. If the pump is unable to suck the preparation, the pump chamber 31 must also be filled to its maximum volume. This can be accomplished by filling the two chambers 22 and 31 through the pump chamber outlet, specifically filling preparation chamber 22 prior to installing valves 32, 33 and filling pump chamber 31 after installing the inner valve 32 but before fitting the outer valve 33', or alternatively, filling the two chambers from the reservoir side with the valves 32, 33 installed, such as by using a filling opening in the preparation chamber wall or in the plunger 21 which is closed after filling.

Figure 2:
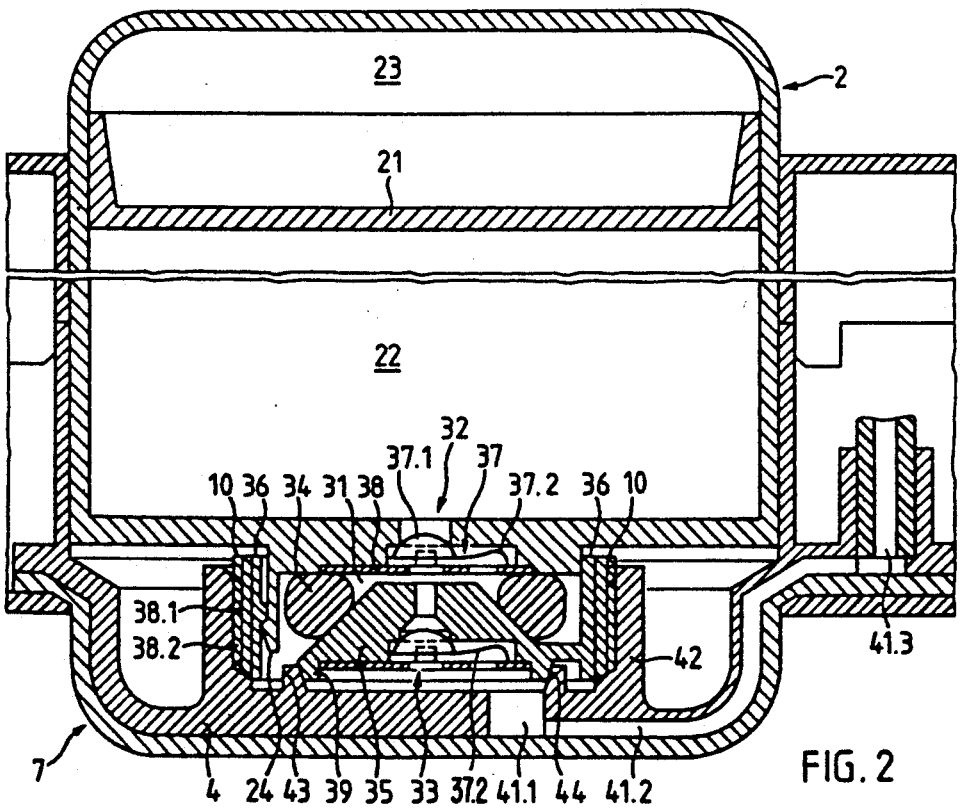
FIG. 2 is a schematic but more detailed sectional view of a second embodiment of the inventive shaver with the fitted replacement cartridge along line A—A of FIG. 3.

As described more fully with reference to FIG. 2, the coupling F between the connecting piece 10 of the replacement cartridge 1 and the counterpart 4 on the shaver is designed in such a way that the reservoir part 10 is movable to a limited extent relative to the connecting part 2 and the counterpart 4 for the compression of the pump chamber and that the forces which are not required for the self-closure coupling are not directed in the same direction as the forces which are required for this relative movement.

If the replacement cartridge 1 is fixed to the shaver by coupling F between the connecting piece 10 and the counterpart 4 by compression (arrows) of the replacement cartridge 1 and the counterpart 4 (or shaver), the pump chamber 31 is compressed. An overpressure is formed therein and consequently outlet valve 33 opens and preparation is fed into the applicator supply channel 41. When the pressure is equalized by the flow, outlet valve 33 closes. When the force from the outside decreases, the pump chamber 31 is enlarged because of its elasticity, so that a vacuum is formed therein. As a result, inlet valve 32 opens and preparation is moved from the preparation chamber 22 into the pump chamber 31, while the plunger 21 moves toward inlet valve 32. As soon as the pressures are equalized again, the inlet valve closes. During each pump movement there is a size reduction of the preparation chamber 22, whereas there is an increase in the size of the air chamber 23 which is open to the outside.

Due to the fact that the reservoir part 2 is subdivided into a preparation chamber 22 and an air chamber 23, the preparation in storage is not in contact with the external air, so that it can be kept for a very long time, because deterioration through introduced bacteria and by oxidation is not possible. A much simpler variant, in which an elastically compressible preparation chamber with a one-way valve for the air intake and a second one-way valve for the preparation outflow functions simultaneously as a reservoir and as a pump, offers no such guarantee, but is a usable embodiment for a corresponding preparation.

The operation of the pump by pressing the reservoir part and the connecting device or shaver against one another permits easy, one-handed use of the shaver. In the same way it is possible to operate a replacement cartridge in the form of a pressure element whose shut-off valve is opened by an identical relative movement between the reservoir and the shaver, which leads to the activation of the feed medium, which is in this case constituted by the propellant gas contained in the pressure element. It would obviously be possible to conceive embodiments in which the connecting device did not participate in the relative movement activating the feed medium and in which this function was instead fulfilled by another part of the replacement cartridge. In such an embodiment the connecting device does not have to be designed for a corresponding force transfer, but then the shaver can no longer be easily guided and operated with one hand.

Figure 3:
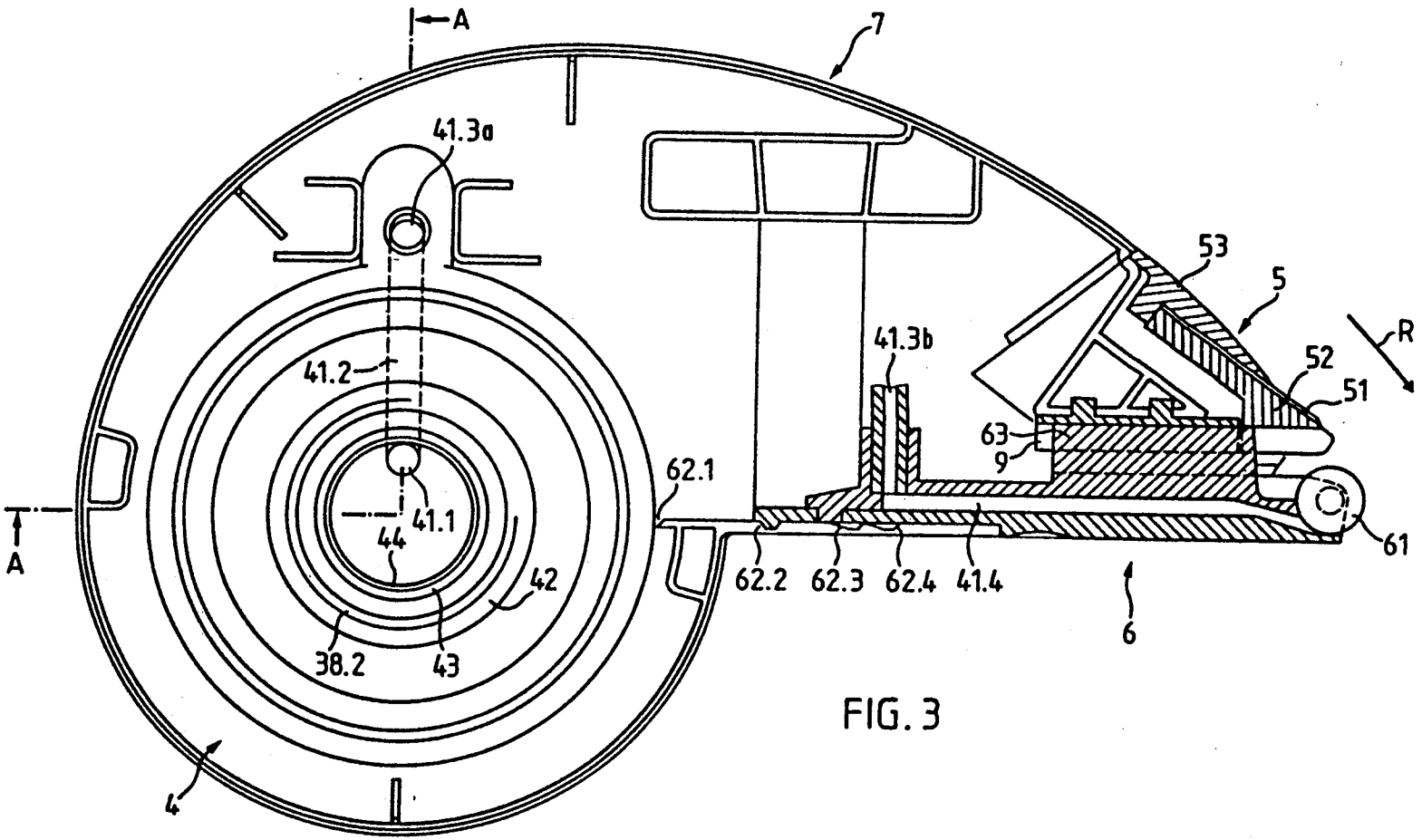
FIG. 3 is a transverse sectional view of the embodiment of FIG. 2 without the replacement cartridge.

FIG. 2 shows in detail an embodiment of the inventive replacement cartridge, which is fitted to a corresponding shaver, which is only partly shown in the drawing. FIG. 3 shows the corresponding shaver without the replacement cartridge 2a. The parts of the replacement cartridge and shaver, whose functions have already been described in conjunction with FIG. 1, are given the same reference numerals, even though they have different configurations. The shaver and the replacement cartridge are shown in sectional form in FIG. 2 along a sectional plane designated A—A in FIG. 3. FIG. 3 shows the shaver without the replacement cartridge in sectional form, in this case the sectional plane being at right angles to that of FIG. 2, and at a reduced scale.

The shaver has a blade unit 5 and an application device 6, the blade unit 5 being positioned in replaceable, but fixed, manner on a casing part 7 whereas the application device 6 is displaceably integrated into casing part 7. The replacement cartridge 1 comprising a reservoir part 2a and a pump part 3 is replaceable and fitted in rigid manner to a mating part 4, the reciprocal pump movement of the reservoir part 2a relative to the connecting piece 10 and part 4 being guided in the casing part 7.

Figure 2A:
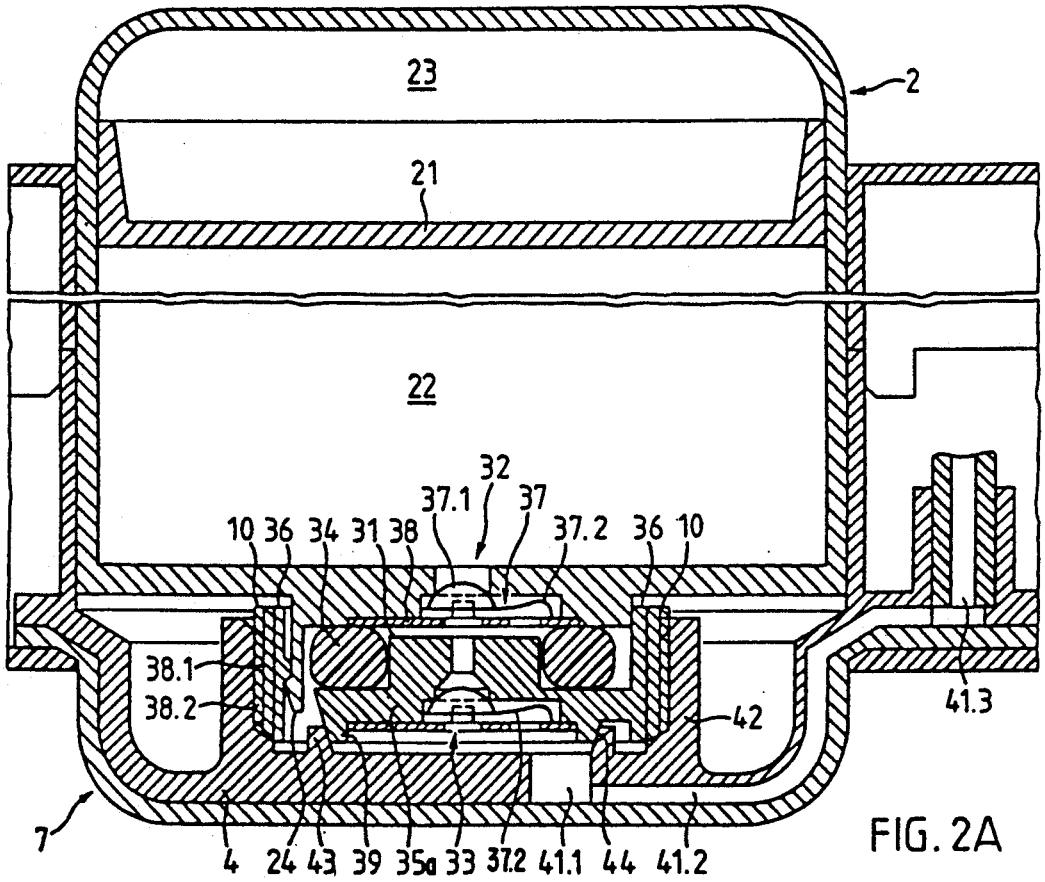
FIG. 2A is a view similar to FIG. 2 showing a modification of the pump structure.

The replacement cartridge reservoir part 2a substantially corresponds to the corresponding part of FIG. 1. However, it additionally comprises shaped portions 24, on which are mounted the pump part by an irreversible coupling. The pump chamber 31 is bounded by the reservoir part wall, by an annular, elastically compressible seal 34 and by the pump body 35. The pump body 35 is provided with shaped portions 36 which, together with the shaped portion 24 of the reservoir part 2, allow an irreversible coupling so that the reservoir part 2a and the pump body 35 are axially movable relative to one another to a limited extent, but relative rotary movement is not possible. This limited reciprocatory axial movement is guided by the shaped portions 24 and 36. It brings about varying compression of the sealing ring 34 and therefore varying size of the pump chamber 31. The sealing ring 34 can be installed between two parallel surfaces as shown in FIG. 2a and with respect to the cross-section and material is designed in such a way that a minimum force is required for its compression. In order to further reduce this force it is possible, as shown in FIG. 2, for one of the surfaces mounting the ring such as the upper surface of body 35 to slope with respect to the other, so that the sloping surface projects conically into the ring. If in such an embodiment the two surfaces are moved against one another, the ring is not only compressed, but is simultaneously pressed against the increasing cross-section of the cone. Thus, with minimum force the pump chamber size can be reduced.

The one-way valves 32, 33 shown in the embodiment of FIG. 2 are cap-shaped valves, which combine the characteristics of diaphragm valves and ball valves. A combined valve member and spring part 37 comprises a valve 37.1 onto which are shaped three spring parts 37.2 (the corresponding parts are only shown in the drawing on the inlet valve 32). The valve member and spring part 37 is slightly deformed by pressing a fixing plate 38 into a mating inward recess of the wall of reservoir part 2a (or the pump body 35 for the outlet valve 33), that the spring parts 37.2 are slightly biased. The biasing is chosen in such a way that in the inoperative state (no pressure differences) the two valves are tight, but for the opening thereof it is only necessary to have forces ensuring easy operation.

Obviously, the aforementioned cap-shaped valve can be replaced by other one-way valves, such as ball or diaphragm valves. It is also not necessary for the two valves to be identical.

The shaped portions 36 of pump body 35 carry on their outside surfaces a connecting piece 10 which is provided with an external thread 38.1. A corresponding internal thread 38.2 is formed on a circular shaped portion 42 of the counterpart 4. With the aid of the threads 38.1 and 38.2 the replacement cartridge 1 is installed in the shaver. In place of threads 38.1 and 38.2, it is also possible to use a bayonet catch or some similar coupling or other fixing means. The mating part 4 is integrated in floating manner in the casing part 7, but can also be fixed therein or form part thereof. Part of the supply channel to the applicator passes through a bore 41.1 in the mating part 4 and continues at 41.2 between the casing part 7 and the mating part 4 passed through a piece of hose (channel part 41.3, only a portion of which is shown in FIG. 2 and two portions of which are shown in FIG. 3) and through the supply channel of the applicator 41.4 to the application roll 61 of the application device 6.

Mating part 4 has various functions. It firstly carries the fixing means to which the replacement cartridge 1 is attached with the aid of the connecting piece 10, such as the internal thread 38.2 Secondly, it forms at least part of the channel system 41.1–41.4 through which the preparation is passed from the replacement cartridgee 1 into application device 6. Thirdly, it comprises a sealing means which, together with corresponding sealing means on the replacement cartridge, tightly seals the channel system at the transition point between the replacement cartridge and the shaver. In the embodiment shown in FIGS. 2 and 3, said sealing means comprise the circular shaped portion 43, which together with a corresponding shaped portion 39 on the pump body 35, forms a common sealing surface 44, which is frustoconical.

In the shaving direction (arrow R) behind the application roll 61 is fitted the blade unit 5. The latter comprises a blade 51, which is secured between a guidance/-protection element 52 and an assembly part 53. Corresponding blade units are described in U.S. Ser. No. 07/754,027 (Now, abandoned). The entire blade unit 5 is a replacement element and, in the embodiment shown, is engaged on the casing part with the aid of elastic connection means.

The application device 6 is displaceable in four different positions relative to the fitted blade unit 5 and locks in corresponding locking point 61.1–61.4. If the application device has been entirely moved back and engages in the locking position 62.1, then the application roll is entirely removed from the cutting area of the blade 51.

This position is advantageously used for cutting longer hair without the application of preparation.

If the application device is locked in the locking position 62.2 (as shown in the drawing), the application roll 61 is in a position relative to the blade 51, which is optimum for shaving and simultaneously applying. If the application device is locked in the locking position 62.3, the shaver can be cleaned, particularly between the application device 6 and the guidance/protection element 52 of the blade unit, where shaved hair can collect. If the application device 6 is locked in the locking position 62.4, part of the application device 6 is located between the casing part 7 and the blade unit 5. In this way the attachment means of the blade unit 5 are deformed in such way that dismantling thereof is possible.

The application device has a cleaning comb 63 which, on displacing the application device, is guided by the tooth-like shaped portions of the guidance/protection element 52 and removes hair deposited between them. To ensure that when the application device is moved back said cleaning comb 63 does not introduce contaminants into the interior of the shaver, it passes through a comb-like part 9 which is fixed to the casing part 7.

We claim:

1. A replacement cartridge in combination with a shaver having a shaving fluid application device comprising a reservoir in said cartridge for holding shaving fluid;

means defining a fluid path extending between said cartridge and said application device, said fluid path being sealed from ambient air;

coupling means including mating parts on said cartridge and said shaver for connecting said cartridge to said shaver and for permitting limited relative reciprocatory movement between said shaver and said cartridge; and shaving fluid feeding means including said means defining said fluid path and responsive to reciprocatory motion between said shaver and said cartridge to feed shaving fluid from said reservoir through said fluid path to said shaver.

2. A cartridge and shaver according to claim 1 wherein said coupling means includes a self-actuating latch.

3. A cartridge and shaver according to claim 1 wherein said feeding means comprises a manually operated pump actuated by reciprocating said cartridge relative to said shaver.

4. A cartridge and shaver according to claim 3 wherein said pump includes first and second rigid and relatively movable elements, an elastically deformable member forming a pump chamber between said relatively movable elements, a first one-way valve between said pump camber and said reservoir and a second one-way valve between said pump chamber and said fluid path.

5. A cartridge and shaver according to claim 4 wherein each of said one-way valves comprises a cop-shaped valve.

6. A cartridge and shaver according to claim 1 wherein said cartridge includes a hollow body and a movable plunger therein dividing said body into said reservoir and an air chamber.

7. A cartridge and shaver according to claim 4 wherein said coupling means includes mating surfaces on said shaver and said cartridge for sealing said fluid path from ambient air.

8. A cartridge and shaver according to claim 1 wherein said coupling means includes a threaded connection.

* * * * *